US007387129B2

(12) United States Patent
Moscherosch et al.

(10) Patent No.: US 7,387,129 B2
(45) Date of Patent: Jun. 17, 2008

(54) DEVICE TO AVOID AUTO-EXTINGUISHING OF CIGARS

(75) Inventors: H. Michael Moscherosch, Doylestown, PA (US); Emma M. Moscherosch, Doylestown, PA (US)

(73) Assignee: Rascals, Rogues and Rapscallions PA (US)

( * ) Notice: Subject to any disclaimer, the term of this patent is extended or adjusted under 35 U.S.C. 154(b) by 528 days.

(21) Appl. No.: 11/011,334

(22) Filed: Dec. 14, 2004

(65) Prior Publication Data

US 2006/0124144 A1 Jun. 15, 2006

(51) Int. Cl.
*A21F 13/22* (2006.01)
*A21F 13/08* (2006.01)
*A21F 13/28* (2006.01)

(52) U.S. Cl. ..... 131/330; 131/175; 131/189; 131/191; 131/260

(58) Field of Classification Search ..... 131/329, 131/330, 240.1, 242, 174, 175, 187–189, 131/191, 235.1, 238, 241, 256, 257–260; D27/183–193
See application file for complete search history.

(56) References Cited

U.S. PATENT DOCUMENTS

| | | | | |
|---|---|---|---|---|
| 1,523,567 | A * | 1/1925 | Surdek et al. | 131/175 |
| 3,978,981 | A | 9/1976 | Musick | |
| 4,019,366 | A * | 4/1977 | Claflin et al. | 73/23.3 |
| 4,198,992 | A | 4/1980 | Smith | |
| 4,907,604 | A | 3/1990 | Beloff | |
| 5,862,809 | A | 1/1999 | Nicotra | |
| 6,089,236 | A | 7/2000 | Alexsen | |
| 6,145,510 | A | 11/2000 | Clark | |
| 6,584,982 | B1 | 7/2003 | Clay et al. | |
| 6,615,840 | B1 | 9/2003 | Fournier et al. | |

OTHER PUBLICATIONS

2007 Home Depot Maintenance warehouse catalogue, 2007, p. 82.*
"My Last Cigar" or "'Twas Off the Blue Canaries," James M. Hubbard, undated.

* cited by examiner

*Primary Examiner*—Eric Hug
(74) *Attorney, Agent, or Firm*—James P. Barr

(57) ABSTRACT

A device that sucks small quantities of air through a lit cigar in order to maintain sufficient oxygen flow to prevent the cigar from going out.

19 Claims, 2 Drawing Sheets

DEVICE TO AVOID AUTO-EXTINGUISHING OF CIGARS

FIELD OF THE INVENTION

The present invention relates to a device that sucks small quantities of air through a lit cigar in order to maintain sufficient oxygen flow to prevent the cigar from going out.

BACKGROUND OF THE INVENTION

Cigar smoking is a peaceful pastime that has been carried on for generations. In a pre-civil war ballad, entitled "My Last Cigar" or "Twas Off the Blue Canaries," James M. Hubbard paid homage to the final puffs of his last cigar while on a ship at sea. The existence of such a ballad attests to the pleasure people obtain from smoking cigars.

Many interesting things have been devised by people to extinguish a cigar when the cigar smoker cannot continue such a pleasurable activity. For example, if one wished to quickly snuff or extinguish the cigar, the methods of U.S. Pat. Nos. 4,907,604 and 5,862,809 would accomplish such a feat. Such patents disclose extinguishing the cigar rapidly using an airtight cap over the lit end of the cigar, thereby forcing the smoker to relight the cigar. However, as any cigar aficionado knows, such relighting has deleterious affects on the taste and flavor of the cigar.

U.S. Pat. Nos. 6,145,510 and 6,089,236 describe other interesting things that try to control the burn rate of a lit cigar using a cigar holding device with adjustable vents to control the flow of air to the lit cigar. However, both devices will sooner or later result in the cigar being extinguished.

Another interesting thing was described in U.S. Pat. No. 3,978,981. This patent describes a tubular receptacle with air vents that allows to transport a lit cigar. However, the cigar would eventually be extinguished if the smoker does not puff the cigar.

U.S. Pat. No. 6,584,982 describes an interesting thing that marks cigarettes for use in a smoking machine.

An interesting thing was described in U.S. Pat. No. 4,198,992. This interesting thing is a smoker's appliance that keeps a cigarette lit using a flexible bulb that is attached to a body that, upon squeezing, forces air into a cylindrical body to keep the cigarette lit. U.S. Pat. No. 6,615,840 describes an interesting thing that is an electrical smoking system for smoking a cigarette. This interesting thing keeps a cigarette lit using a lighter that has a heating blade and a controller.

While the aforementioned devices and methods may be interesting things, none describe a device that keeps the cigar lit throughout its burn and prevents the cigar from being extinguished. Such a device should keep a cigar lit without requiring the smoker to puff the cigar.

The present invention solves these problems by providing a device or a holder that actively sucks air through a lit cigar to simulate the puffs of the smoker. The holder applies suction at the unlit end of the cigar, therefore allowing air to flow through the cigar to prevent self-extinguishing of the cigar. Using such a device, the smoker does not need to puff the cigar in order to keep the cigar burning. Such a device is indeed a very interesting thing.

SUMMARY OF THE INVENTION

In accordance with the present invention, there has been provided a device that is adapted to suck air through a lit cigar to maintain a sufficient flow of oxygen through the cigar to prevent the cigar from going out, the device comprising a cigar holder adapted to receive an unlit end of a lit cigar on a first end thereof, a suction tube extending from the cigar holder on a second end thereof, the second end being opposite the first end, a funnel adapted to be placed in vertical registration with a lit end of the cigar, the funnel having a relatively wide first opening and an opposite relatively narrower second opening, the first opening being adjacent the lit end of the cigar and the second opening extending vertically upward away from the cigar into a vertically extending chimney, the funnel being adapted to capture heat emanating from the lit end of the cigar, wherein the suction tube extends into the chimney adjacent to and vertically above the second opening of the funnel such that air flowing through the cigar flows through the suction tube exiting into the chimney directly above the second opening to create a venturi effect.

Other embodiments and features of the present invention will become apparent to those ordinarily skilled in the art upon review of the following description of specific embodiments of the invention in conjunction with the accompanying drawings.

DETAILED DESCRIPTION

Figure 1:
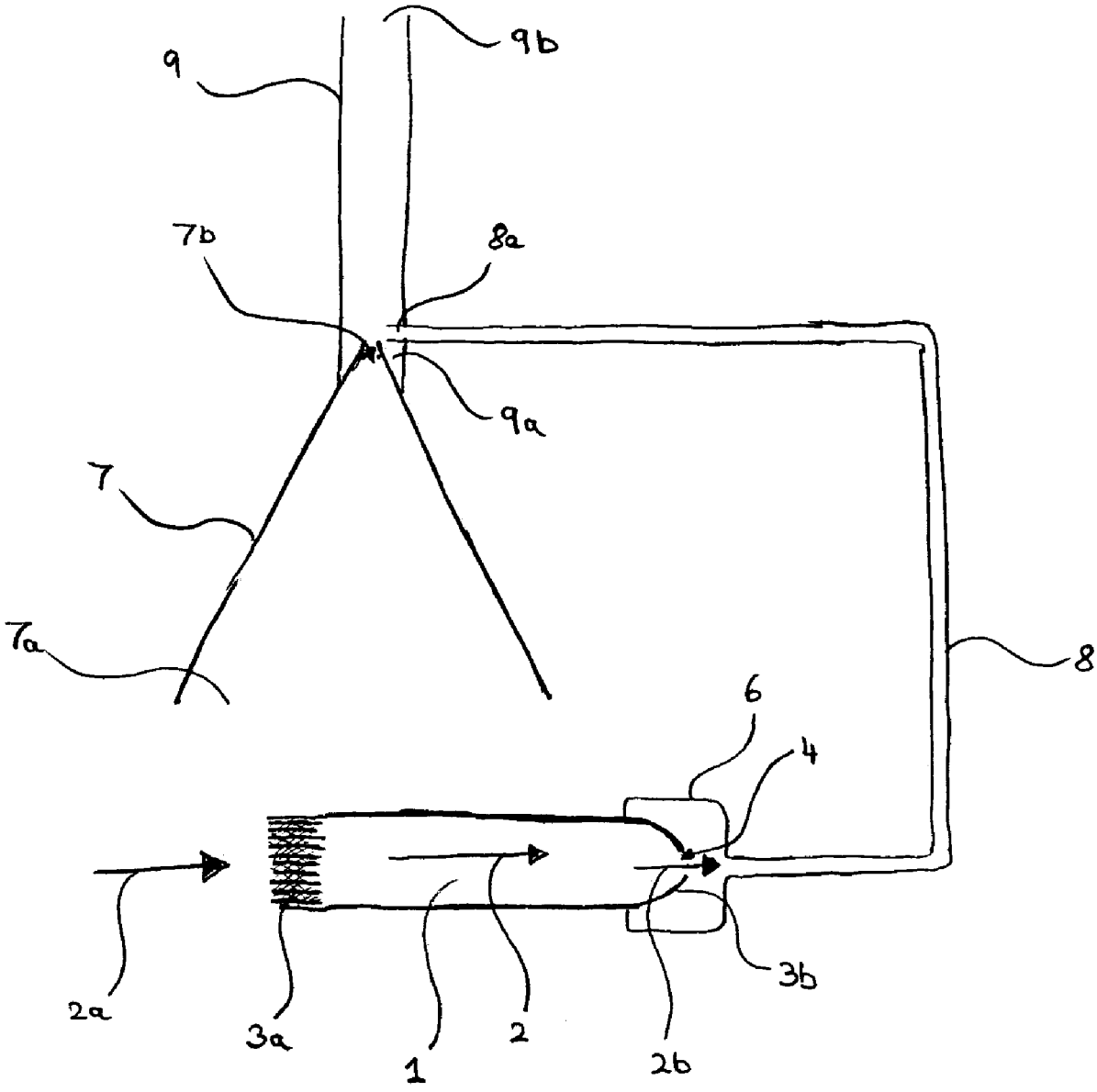
FIG. 1 is a cross-sectional view of a device in accordance with the present invention.

Referring to FIG. 1 there is shown an embodiment of the present invention, a device that is adapted to suck air through a lit cigar 1 to maintain a sufficient flow of oxygen through the cigar to prevent the cigar from going out. The cigar, as shown, has a lit end 3*a* and an opposite unlit end 3*b*, the unlit end 3*b* having been cut prior to lighting the opposite end of the cigar to permit the flow of air through a cut end 4. The device comprises a cigar holder 6 that is in the form of a housing that is adapted to receive the unlit end 3*b* of a lit cigar 1 on a first end thereof and which constricts to a smaller diameter on an opposite second end. The cigar holder should provide an air tight fit around the diameter of the cigar when the unlit end is inserted into the cigar holder and should be hollow to permit the flow of air through the cigar 1 and the cigar holder 6. In a preferred embodiment, the cigar holder 6 may be formed from a flexible or malleable material such as for example a flexible rubber gasket or a constrictable variable diameter aperture such as found on a camera lens.

A suction tube 8 extends from the second end of cigar holder 6. The suction tube is in the form of a hollow tube and is capable of drawing air throughout the entire length of the suction tube. The suction tube may be in the form of a flexible hose or alternatively may be a metal tube or pipe such as a copper pipe. The internal diameter of the suction tube is not, per se, critical to the invention provided of course that it permits the flow of air through its entire length. Suitable diameters range from about 1 mm to about 10 mm and are preferably about 3 mm to 5 mm.

The device further includes a funnel 7 that is adapted to be placed in vertical registration with the lit end of the cigar 1. The funnel 7 is in the form of a cone having a relatively wide first opening and an opposite relatively narrower second opening opposite the first opening. The first opening is located adjacent the lit end of the cigar 1 and the second opening extends vertically upward away from the cigar. The funnel 7 is adapted to capture heat emanating from the lit end of the cigar. That is, as the lit end of the cigar burns, it heats the surrounding air causing the air to expand and rise upward. The function of the funnel is to capture the rising air and direct it through the funnel in an upward direction. Since the diameter of the funnel 7 constricts over its length, the flow of the upwardly expanding air increases in velocity.

The second opening of the funnel 7 extends into a vertically extending chimney 9. In addition, the suction tube 8 also extends into the chimney 8, the suction tube having an end that is located adjacent to and vertically above the second opening of the funnel 7. The chimney 9 is in the form of a hollow tube having an internal diameter that is at least equivalent to or is preferably greater than the diameter of the second opening of the funnel. It has been found that by providing the chimney 9 with a greater diameter than the second opening of the funnel 7, a venturi effect is created thus drawing air through the suction tube 8 which in turn continuously draws air through the cigar 1.

It is an important feature of the present invention that the funnel be configured to provide sufficient vertical air flow to create a venturi effect thereby drawing sufficient air through the suction tube to maintain the cigar in a lighted condition. A suitable air flow through the suction tube should be at least about 60 cc/min. Based upon this air flow, it has been found that the funnel 7 should have a first opening diameter of between about 25 mm and about 100 mm, length of at least about 25 mm and a second opening diameter of between about 1 mm and less than 25 mm. By increasing the length of the funnel 7, the velocity of air flow also increases thereby improving the efficiency of the device. However, it is important to recognize that it is undesirable to increase the air flow through the suction tube to such an extent that the cigar burns too rapidly.

Thus, in accordance with a preferred embodiment, the suction tube is further provided with a flow metering device that is adapted to restrict, if necessary the flow of air through the suction tube. Such flow restricting device may be in the form of a metering valve which allows the user to either partially or completely shut off the flow of air through the suction device. Such metering valves are well known to those skilled in the art and the choice of a particular type of metering valve is no critical to the invention.

Figure 2:
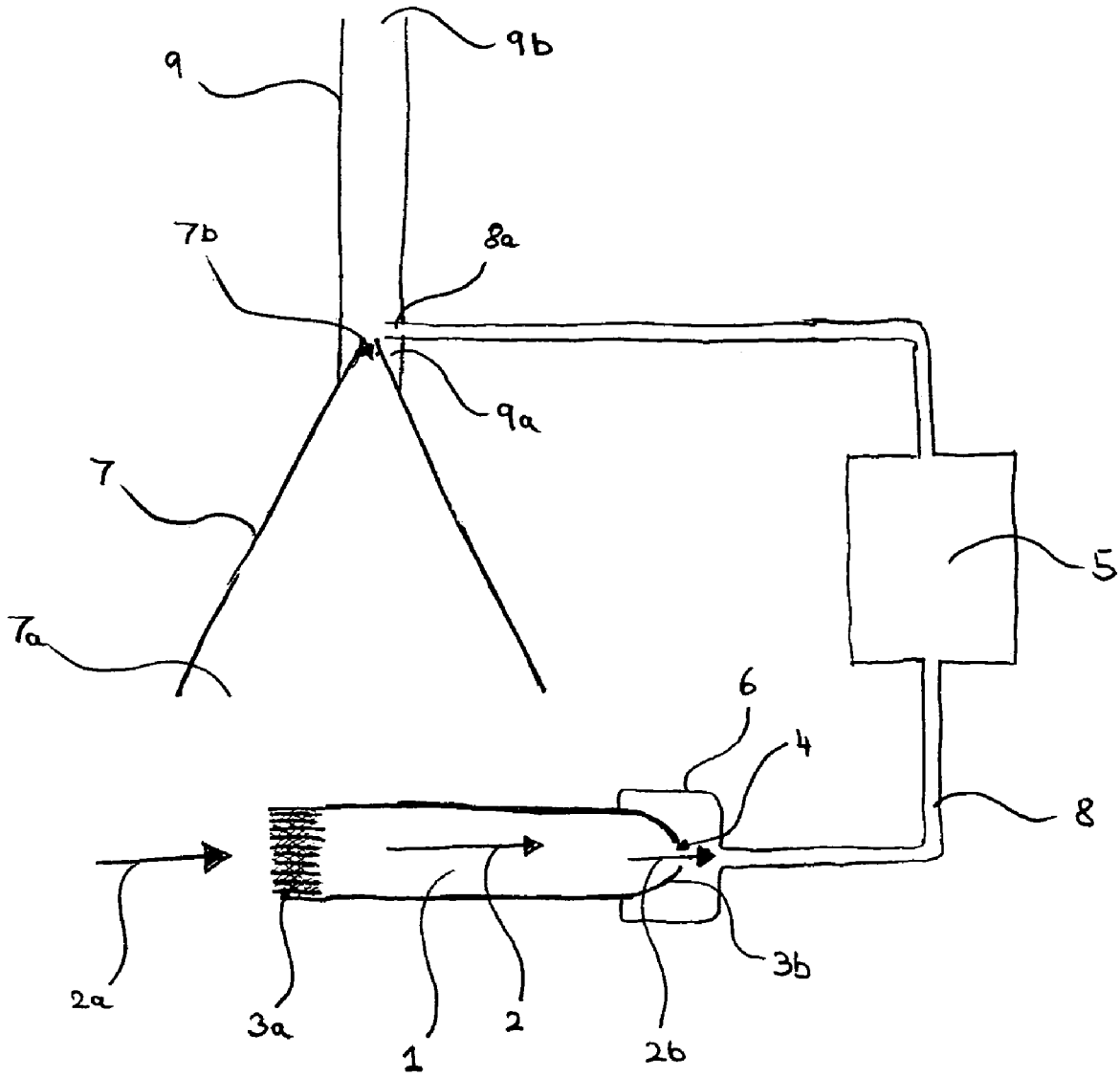
FIG. 2 is a cross-sectional view of the suction tube having a vacuum pump in accordance with an alternative embodiment of the present invention.

In accordance with yet another optional embodiment of the invention, the suction tube may be provided with a vacuum pump device to further enhance the air flow through the suction tube. As illustrated in FIG. 2, the vacuum pump is located between the cigar 1 and the chimney 9, and is preferably capable of intermittent use to either assist in the initial start of air flow through the suction tube, or to provide subsequent enhanced air flow through the suction tube in the event that the temperature of the lit end of the cigar is insufficient, by itself, to maintain continuous air flow conditions.

We claim:

1. A device that is adapted to suck air through a lit cigar to maintain a sufficient flow of oxygen through the cigar to prevent the cigar from going out, the device comprising a cigar holder adapted to receive an unlit end of a lit cigar on a first end thereof, a suction tube extending from the cigar holder on a second end thereof, the second end being opposite the first end, a funnel adapted to be placed in vertical registration with a lit end of the cigar, the funnel having a relatively wide first opening and an opposite relatively narrower second opening, the first opening being adjacent the lit end of the cigar and the second opening extending vertically upward away from the cigar into a vertically extending chimney, the funnel being adapted to capture heat emanating from the lit end of the cigar, wherein the suction tube extends into the chimney adjacent to and vertically above the second opening of the funnel such that air flowing through the cigar flows through the suction tube exiting into the chimney directly above the second opening to create a venturi effect.

2. The device according to claim 1 wherein the suction tube is a hollow tube adapted to draw air throughout an entire length of the suction tube.

3. The device according to claim 1 wherein the suction tube is a flexible hose.

4. The device according to claim 1 wherein the suction tube is a metal tube.

5. The device according to claim 1 wherein the suction tube has an internal diameter of from about 1 mm to about 10 mm.

6. The device according to claim 1 wherein the suction tube has in internal diameter of from about 3 mm to 5 mm.

7. The device according to claim 1 wherein the funnel is adapted to be placed in vertical registration with the lit end of the cigar and wherein the funnel is a cone having a relatively wide first opening and an opposite relatively narrower second opening opposite the first opening, the first opening being located adjacent the lit end of the cigar and the second opening extending vertically upward away from the cigar.

8. The device according to claim 1 wherein the funnel is adapted to capture heat emanating from a lit end of the cigar and direct the heat through the funnel in an upward direction.

9. The device according to claim 1 wherein the second opening of the funnel extends into a vertically extending chimney.

10. The device according to claim 9 wherein the suction tube extends into the chimney, the suction tube having an end that is located adjacent to and vertically above the second opening of the funnel.

11. The device according to claim 1 wherein the chimney is a hollow tube having an internal diameter that is at least equivalent to the diameter of the second opening of the funnel.

12. The device according to claim 1 wherein the chimney has a greater diameter than the second opening of the funnel.

13. The device according to claim 1 wherein the funnel is configured to provide a vertical air flow of at least about 60 cc/mm.

14. The device according to claim 1 wherein the funnel has a first opening diameter of between about 25 mm and about 100 mm, a length of at least about 25 mm and a second opening diameter of between about 1 mm and less than 25 mm.

15. The device according to claim 1 wherein the suction tube is further provided with a flow metering device that is adapted to restrict the flow of air through the suction tube.

16. The device according to claim 15 wherein the flow metering device is a metering valve which is adapted to either partially or completely shut off the flow of air through the suction device.

17. The device according to claim 1 wherein the suction tube is provided with a vacuum pump to further enhance air flow through the suction tube.

18. The device according to claim 17 wherein the vacuum pump is located between the cigar and the chimney.

19. The device according to claim 17 wherein the vacuum pump is capable of intermittent use.

* * * * *